United States Patent [19]

Garrison et al.

[11] 4,272,068

[45] Jun. 9, 1981

[54] ROLL-WAVE SHEET SEPARATOR STRUCTURE

[75] Inventors: Stephen P. Garrison, Austin; Elmer L. B. Kroeker, Round Rock, both of Tex.

[73] Assignee: International Business Machines Corporation, Armonk, N.Y.

[21] Appl. No.: 53,484

[22] Filed: Jun. 29, 1979

[51] Int. Cl.[3] ..... B65H 3/06

[52] U.S. Cl. ..... 271/117; 271/120

[58] Field of Search ..... 271/19, 21, 37, 109, 271/113, 114, 116–118, 119, 120; 74/9

[56] References Cited

U.S. PATENT DOCUMENTS

| | | | |
|---|---|---|---|
| 1,489,149 | 4/1924 | Pelto | 74/9 |
| 3,008,709 | 11/1961 | Buslik | 271/10 |
| 3,276,770 | 10/1966 | Griswold | 271/19 |
| 3,970,299 | 7/1976 | Berger, Jr. et al. | 271/250 |
| 4,165,870 | 8/1979 | Fallon et al. | 271/250 X |

OTHER PUBLICATIONS

IBM Technical Disclosure Bulletin; vol. 20, No. 6, pp. 2117–2118, "Combing Wheel Paper Feed," Colglazier et al.; 11–1977.

IBM Technical Disclosure Bulletin; vol. 20, No. 8, p. 2933, "Paper Feed Wheel," Hunt 1–1978.

IBM Technical Disclosure Bulletin; vol. 21, No. 2, p. 477, "Sheet Shingler," Fallon et al.; 7–1978.

*Primary Examiner*—Robert W. Saifer

*Attorney, Agent, or Firm*—J. B. Kraft

[57] ABSTRACT

A roll-wave sheet separator is provided which comprises a sheet support for supporting a stack of sheets and a sheet separator mounted adjacent to the stack which comprise a rotatable shaft having a helical peripheral thread coaxial with the shaft, and a follower rotatable around the shaft which follows the helical thread to move along the shaft axis. The follower supports at least one circular element which is preferably freely rotatable. The apparatus further includes a motor for rotating the shaft in one direction to drive the follower and its supported circular elements against the surface of the outermost sheet in the stack so that rotation of the circular element against the uppermost sheet in the stack will shingle that sheet from the stack. A brake is provided for abruptly stopping the rotation of the shaft whereby the follower and its supported element will then move back along the shaft out of engagement with the sheet surface. At this point the sheet may be removed, after which the circular elements are again driven into engagement with the next uppermost sheet to shingle the same.

8 Claims, 2 Drawing Figures

ROLL-WAVE SHEET SEPARATOR STRUCTURE

DESCRIPTION

BACKGROUND OF THE INVENTION

The present invention relates to apparatus for separating sheets from a stack so that the sheets may be fed to sheet processing apparatus such as printers. More particularly, the invention relates to sheet separating apparatus which operates on the "roll-wave" principle to separate sheets from a stack of sheets. This roll-wave principle of sheet separation was first described in U.S. Pat. No. 3,008,709 to W. S. Buslik as well as in an extensive number of subsequent publications including the publication, "Paper Feed Wheel," R. E. Hunt, *IBM Technical Disclosure Bulletin*, January 1978, page 2933; "*Trailing Edge Paper Feeding Apparatus*", R. E. Hunt, *IBM Technical Disclosure Bulletin*, October 1977, page 1678; "Combing Wheel Paper Feed," D. F. Colglazier, E. P. Kollar and F. R. Mares, *IBM Technical Disclosure Bulletin*, November 1977, page 2117; "Improved Shingler Design," E. J. Friery and B. H. Kunz, *IBM Technical Disclosure Bulletin*, December 1977, page 2579; "Sheet Shingler," J. L. Fallon, R. E. Hunt, E. P. Kollar, and J. H. Rhodes, Jr., *IBM Technical Disclosure Bulletin*, July 1978, page 477. As set forth in the basic patent and subsequent publications, the roll-wave principle involves the recognition that by urging a circular member such as a ball or roller into engagement with the surface of the uppermost sheet in a stack of paper or similar sheet material while applying only a minimum of pressure which would be necessary to form a slight deformity or depression in the several uppermost sheets beneath the circular element, then when the circular element is moved across the surface, and particularly if the circular element is free rolling, the slight indentation in the uppermost sheets will shift or roll like a wave following the moving circular element. This wave will in effect be transmitted to the edge of the stack of sheets and will result in the shingling of the uppermost sheets which were subject to the roll-wave depression.

Once the sheets are thus shingled, they are much easier to separate from the top of the stack with conventional sheet feed apparatus as described in the above art. During the period in the cycle when the shingled top sheet or sheets are being removed from the stack by the sheet feed apparatus, it is desirable that the circular member be withdrawn from engagement with the paper so that it will in no way impede the removal operations. In the prior art this is accomplished by a withdrawal expedient which lifts the circular shingling member away from the paper stack.

Among the most significant aspects of roll-wave paper shingling is the maintenance of a preselected constant pressure by the circular or roller element upon the surface of the uppermost sheet in the stack. If the pressure is too slight, there will be substantially no indentation and consequently no roll-wave to create the shingling. On the other hand, if the pressure is too great, paper buckling and damage may take place.

BRIEF DESCRIPTION OF THE PRESENT INVENTION

Accordingly, it is a primary object of the present invention to provide apparatus for shingling the outermost sheets from a stack by roll-wave separating means which maintain minimal uniform pressure on the surface of the outermost sheet in the stack during shingling.

It is another object of the present invention to provide roll-wave shingling means which apply uniform pressure to the outermost sheet in the stack irrespective of stack thickness variations.

It is a further object of the present invention to provide roll-wave shingling means which have the capability of readily withdrawing from contact with the stack so that the shingled sheets may be removed.

The above objects are carried out through sheet separating apparatus which comprise means for supporting a stack of sheets and sheet separating means mounted adjacent to the stack which comprise a rotatable shaft having a helical peripheral thread coaxial with a shaft, a follower rotatable about the shaft following the helical thread to move along a shaft axis, at least one circular element supported on the follower and means for rotating the shaft in one direction to drive the follower and the supported element against the surface of the outermost sheet in the stack to thereby shingle said sheet away from said stack. The apparatus further includes means for abruptly stopping the rotation of the shaft whereby the follower together with said element move along the shaft back out of engagement with the sheet surface. Preferably the circular element mounted on the follower is free rolling. Balls or rollers are very effective for this purpose.

Copending application, Ser. No. 53,647, "Multiple Stack Roll-Wave Sheet Separator Apparatus," H. R. Woodard, filed on the same day as the present application provides apparatus in which a single shaft with dual opposite helical threads is used in shingling two stacks in opposite directions.

BRIEF DESCRIPTION OF THE DRAWINGS

Referring now to the drawings, wherein a preferred embodiment of the invention is illustrated, and wherein like reference numerals are used throughout to designate like parts.

DESCRIPTION OF THE PREFERRED EMBODIMENTS

Figure 1:
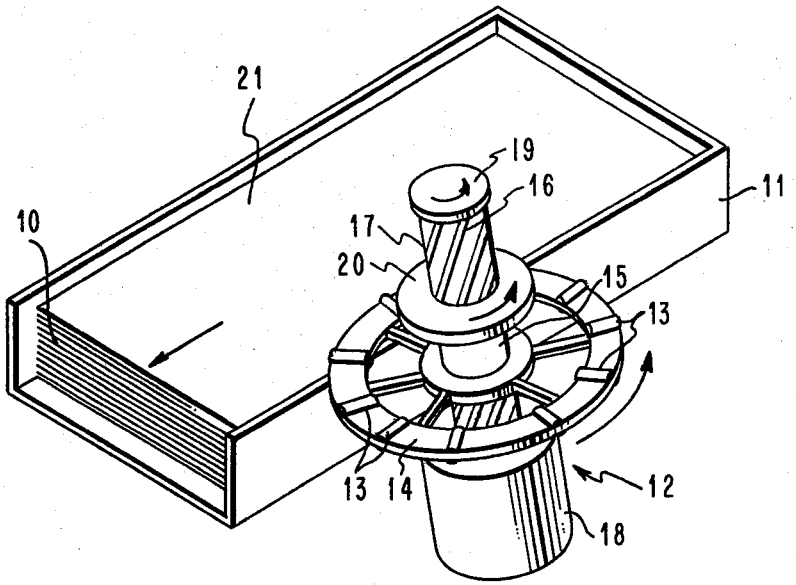
FIG. 1 is a diagrammatic isometric view of the sheet separator apparatus of the present invention.
Figure 2:
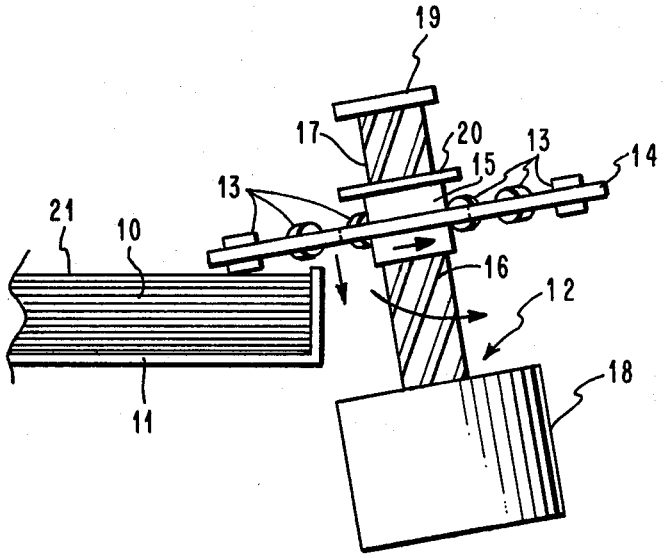
FIG. 2 is a partial diagrammatic front view of the sheet separator of the present invention facing the sheet stack of FIG. 1 in the direction of sheet feed.

The stack of sheets to be shingled 10 is stored in sheet receptacle 11, FIGS. 1 and 2. In FIG. 2, several of the rollers 13 of roll-wave separating means 12 facing the viewer have been removed to more clearly show the drive apparatus. Rollers 13 are supported on ring 14 so as to be freely rotatable within said ring. Ring 14 is fixed to follower 15 which has an internal thread (not shown) mating with helical thread 16 on shaft 17. Housing 18 which is affixed to the frame (not shown) of the apparatus supports shaft 17 in the position shown and contains drive means which rotate shaft 17 in the direction shown by the arrows.

Rollers 13 supported in ring 14 may have a structure comprising a plurality of balls arranged so as to be freely rotatable within the supporting ring as in U.S. Pat. No. 3,008,709. Preferably they have a structure like that shown in the present drawing or like that in above-mentioned publications in the *IBM Technical Disclosure Bulletin*, January 1978, p. 2933 and July 1978, p. 477, i.e., a plurality of freely rotatable rollers supported peripherally in a rotating ring structure. In the initial or non-feed position, follower 15 and supported rollers 13 are maintained spaced from paper stack 10 so that all rollers are out of engagement with the paper stack. In such a structure, means are provided for retaining follower 15 up the shaft away from stack 10. Conveniently, magnetic means may be provided to magnetize plate 19 so that it magnetically engages and holds top surface 20 of follower 15 during the period when shaft 17 is not rotating. Then, in order to commence the shingling operation, shaft 17 is rotated at a velocity sufficient to drive follower 15 out of magnetic engagement with plate 19 down the shaft along helical thread 16 until rollers 13 carried on rotating ring 14 successively engage the top sheet 21 in stack 10 to produce the roll-wave shingling effect described in the above patent and publications. This helical drive urging follower down into engagement with the paper stack is similar to the drive used in the automotive industry in the inertia gear drive for starters. In this type of starter, a pinion or follower is shifted along an armature shaft on a quick screw thread. With the structure shown in FIGS. 1 and 2, rollers 13 may be readily brought out of engagement with the top sheet 21 by abruptly stopping the rotation of shaft 17. Then, the momentum which has been imparted to follower 15 will be dissipated by rotating the follower back up shaft 17 along helical thread 16 until the top of the follower is magnetically reengaged with plate 19 to maintain rollers 13 out of engagement with stack 10.

During the period when rollers 13 are out of engagement with stack 10, one or more of the uppermost shingled sheets may be removed by any standard paper handling expedient, after which the rotation of shaft 17 may be resumed to bring rollers 13 back down into engagement with the uppermost sheet in the remaining stack. Because of the nature of the helical drive mechanism, rollers 13 will exert the same force on paper stack 10 irrespective of the diminishing thickness of stack 10 as sheets are shingled and removed. This is the case because the pressure exerted by rollers 13 is determined primarily by a combination of factors including the rotational velocity of the shaft, the mass of the wheel, the angle of the helix and the drag of the rollers 13, but in no way by the thickness of the stack of paper.

While the invention has been particularly shown and described with reference to a particular embodiment, it will be understood by those skilled in the art that various changes in form and detail may be made without departing from the spirit and scope of the invention.

What is claimed is:

1. Sheet separating apparatus comprising:

means for supporting a stack of sheets, and sheet separating means mounted adjacent to said stack comprising:

a rotatable shaft having a helical peripheral thread coaxial with said shaft, a follower rotatable about said shaft following said helical thread to move along the shaft axis, at least one circular element supported on said follower, means for rotating the shaft in one direction to drive said follower and said at least one circular element against the surface of the outermost sheet in said stack to shingle said sheet from said stack, and means for abruptly stopping the rotation of the shaft whereby said follower and said element moves along said shaft back out of engagement with said sheet surface.

2. The sheet separating apparatus of claim 1 wherein said at least one circular element is free rolling.

3. The sheet separating apparatus of claim 2 wherein a plurality of said free rolling circular elements are supported on said follower.

4. The sheet separating apparatus of claim 2 further including means for maintaining said follower and the supported circular element spaced from said outermost sheet when said shaft is not rotating, and wherein the drive force of the shaft when rotated being sufficient to overcome the force exerted by said maintaining means.

5. The sheet separating apparatus of claim 4 wherein said maintaining means are magnetic.

6. The sheet separating apparatus of claim 2 wherein said circular elements rotate about said shaft and said shingling is in a direction tangential to the path of said rotation.

7. The sheet separating apparatus of claim 2 or claim 3 or claim 6 further including means for removing said shingled uppermost sheet whereupon said follower and circular elements are driven against the surface of said next uppermost sheet.

8. The separating apparatus of claim 2 further including means for removing the shingled uppermost sheet, said removing means being operable after the shaft has backed out of engagement with the stack and before said follower and circular elements are redriven against the surface of the next uppermost sheet.

* * * * *